US007150258B1

(12) United States Patent
McDonald

(10) Patent No.: US 7,150,258 B1
(45) Date of Patent: Dec. 19, 2006

(54) SYSTEM AND METHOD FOR ENCAPSULATING HIGH TEMPERATURE SURFACE PORTIONS OF A MACHINE COMPONENT

(75) Inventor: Terry McDonald, Mount Carmel, IL (US)

(73) Assignee: Foundation Coal Development Corporation, Linthicum Heights, MD (US)

( * ) Notice: Subject to any disclaimer, the term of this patent is extended or adjusted under 35 U.S.C. 154(b) by 0 days.

(21) Appl. No.: 11/187,351

(22) Filed: Jul. 21, 2005

(51) Int. Cl.
*F02B 77/00* (2006.01)
*F01P 9/00* (2006.01)

(52) U.S. Cl. ..... 123/195 C; 123/41.01

(58) Field of Classification Search ..... 123/41.01, 123/41.31, 41.72, 195 C, 198 E, 198 R
See application file for complete search history.

(56) References Cited

U.S. PATENT DOCUMENTS

| | | | | |
|---|---|---|---|---|
| 4,163,061 A | * | 7/1979 | Frandsen et al. | 514/455 |
| 4,671,060 A | | 6/1987 | Wilkens | |
| 5,272,874 A | | 12/1993 | Paas | |
| 5,431,706 A | | 7/1995 | Paas | |
| 5,488,826 A | | 2/1996 | Paas | |
| 5,785,030 A | | 7/1998 | Paas | |
| 6,502,392 B1 | | 1/2003 | Paas | |

FOREIGN PATENT DOCUMENTS

| | | |
|---|---|---|
| GB | 903493 | 8/1962 |
| GB | 1037339 | 7/1966 |
| GB | 1303336 | 1/1973 |

* cited by examiner

*Primary Examiner*—Noah P. Kamen
(74) *Attorney, Agent, or Firm*—Dahl & Chetlin, LLC

(57) ABSTRACT

An anti-explosion and anti-fire system is disclosed, the system comprising an encapsulant disposed to cover high temperature surface portions of a component; a conduit in thermal connection with the encapsulant; and a heat transfer fluid disposed within the conduit. A diesel engine is disclosed for an underground mine, the engine comprising an encapsulant disposed to cover high temperature surface portions of a cylinder head; a conduit in thermal connection with the encapsulant; and a heat transfer fluid disposed within the conduit. A method for encapsulating high temperature surface portions of a cylinder head is disclosed, the method comprising positioning a conduit adjacent the head; positioning an encapsulant in thermal connection with the head and the conduit; and transferring heat from high temperature portions to prevent gasses, coal dust, fuel, oils or other combustible material in an underground mine from contacting portions at temperatures above an explosion or fire safety limit.

25 Claims, 13 Drawing Sheets

SYSTEM AND METHOD FOR ENCAPSULATING HIGH TEMPERATURE SURFACE PORTIONS OF A MACHINE COMPONENT

BACKGROUND

Diesel engines power a wide variety of vehicles and equipment used in various underground and mining applications due to their improved safety and efficiency over electrically powered vehicles and equipment. However, diesel engines are not without their disadvantages and there remain several problems that need to be solved before diesel engines can be fully utilized in such environments.

Diesel engines and other mechanical components used in various underground and mining applications generally include high temperature surface portions which may exceed a safety limit for explosion of gasses or fire hazard from coal dust, fuel, oils or other combustible materials present in the underground mine. In order to be certified explosion proof for use in underground or mining applications, the Mine Safety and Health Administration (MSHA) limits the maximum surface temperature of diesel engines and other mechanical components. However, regulation of such high temperature surface portions of diesel engines and other mechanical components can be difficult inasmuch as MSHA has not approved thermal regulation designs with blankets or insulation.

There are several safety concerns about the use of blankets or insulation for regulating high temperature surfaces of diesel engines and other mechanical components. One issue is inadequate sealing of the blankets or insulation to the engine or other component. Another issue is possible removal or wear of the blankets or insulation previously disposed on the engine or other component. Each of these issues may allow gasses, coal dust, fuel, oils or other combustible materials present in an underground mine to contact hot surfaces. Still another issue is that blankets or insulation only shield, and do not dissipate, heat present at hot surfaces of diesel engines or other mechanical components.

SUMMARY OF THE INVENTION

In one embodiment, there is provided an anti-explosion and anti-fire system for thermal regulation of high temperature surface portions of a machine component used in an underground mine, the anti-explosion and anti-fire system comprising an encapsulant material disposed to cover the high temperature surface portions of the machine component, wherein the encapsulant material is disposed on the machine component to prevent combustible material in the underground mine from contacting the high temperature surface portions of the machine component, and wherein the encapsulant material transfers heat away from the high temperature surface portions of the machine component; a fluid conduit in thermal connection with the encapsulant material, wherein the fluid conduit receives at least a portion of the heat transferred away from the high temperature surface portions of the machine component by the encapsulant material; and a heat transfer fluid disposed within the fluid conduit, wherein the heat transfer fluid transfers at least a portion of the heat received by the fluid conduit from the encapsulant to another location away from the high temperature surface portions of the machine component.

In another embodiment, there is provided a diesel engine for use in an underground mine, the diesel engine comprising an encapsulant material disposed to cover high temperature surface portions of a cylinder head of the diesel engine, wherein the encapsulant material is disposed on the cylinder heat to prevent direct contact of combustible material in the underground mine with the high temperature surface portions of the cylinder head, and wherein the encapsulant material transfers heat away from the high temperature surface portions of the cylinder head; a fluid conduit in thermal connection with the encapsulant material, wherein the fluid conduit receives at least a portion of the heat transferred by the encapsulant material away from the high temperature surface portions of the cylinder head; and a heat transfer fluid disposed within the fluid conduit, wherein the heat transfer fluid transfers at least a portion of the heat received by the fluid conduit from the encapsulant to another location away from the high temperature surface portions of the cylinder head; and wherein the encapsulant material and the cylinder head are attached together to permit selective removal of the cylinder head from the engine block; and wherein dimensions of the encapsulant material, dimensions of the fluid conduit and volume of the heat transfer fluid are selected to dissipate heat at the high temperature surface portions of the cylinder head from temperatures above a safety limit for fire and explosion in the underground mine so as to prevent combustible material in the underground mine from contacting surface portions of the diesel engine at temperatures above the safety limit for fire and explosion.

In one embodiment, there is disclosed a method for encapsulating high temperature surface portions of a cylinder head of a diesel engine for regulation of temperature below a safety limit for fire and explosion in an underground mine, the method comprising positioning a fluid conduit adjacent the high temperature surface portions of the cylinder head; positioning an encapsulant material in thermal connection with the high temperature surface portions of the cylinder head and the fluid conduit, wherein the encapsulant material is positioned to cover the surface of the cylinder head so as to prevent combustible material in the underground mine from contacting the high temperature surface portions of the cylinder head above the safety limit for fire and explosion; and transferring heat from the high temperature surface portions of the cylinder head covered by the encapsulant material through a heat transfer fluid disposed within the fluid conduit to another location away from the high temperature surface portions of the cylinder head so as to prevent combustible material in the underground mine from contacting surface portions of the diesel engine at temperatures above the safety limit for fire and explosion.

In another embodiment, there is disclosed a method for forming an encapsulating layer on a mechanical component for regulation of temperature, wherein the method comprises placing a fluid conduit adjacent to high temperature surface portions of the mechanical component; placing a frame component adjacent to the fluid conduit so as to create a form for filling a bath of encapsulation material in a fluid state; adding encapsulation material adjacent to high temperature surface portions of the mechanical component, and removing at least a portion of the frame component after encapsulation material has hardened.

Other embodiments are also disclosed.

BRIEF DESCRIPTION OF THE DRAWINGS

Illustrative embodiments of the invention are illustrated in the drawings, in which.

DETAILED DESCRIPTION OF AN EMBODIMENT

Figure 1:
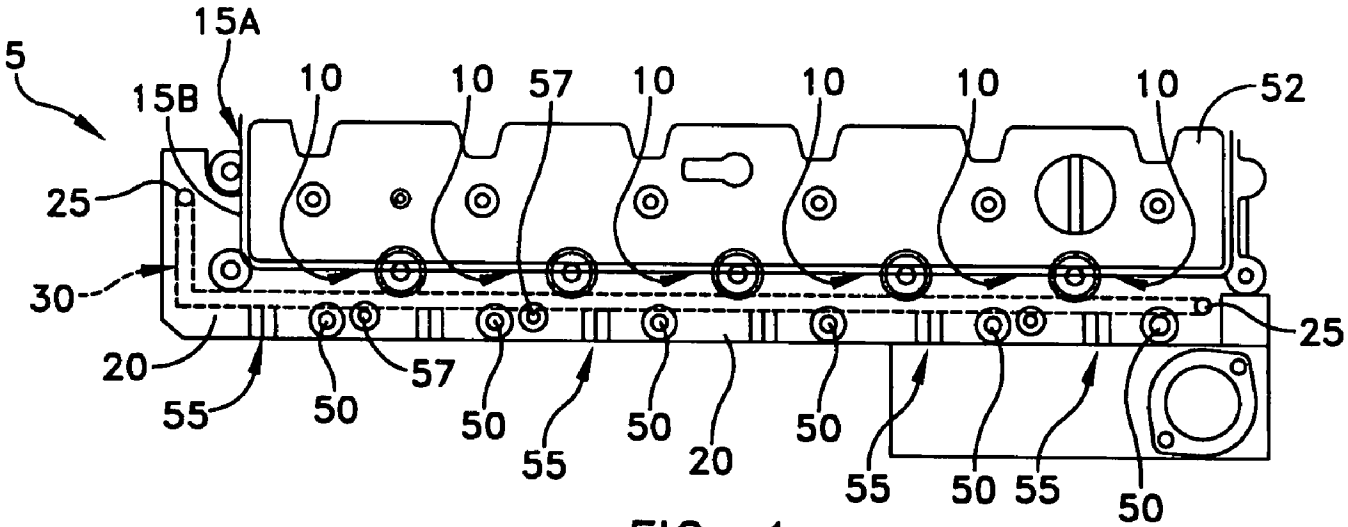
FIG. 1 illustrates a top planar view of an anti-explosion and anti-fire system having an encapsulant material disposed on surfaces of the cylinder head of a diesel engine.
Figure 2:
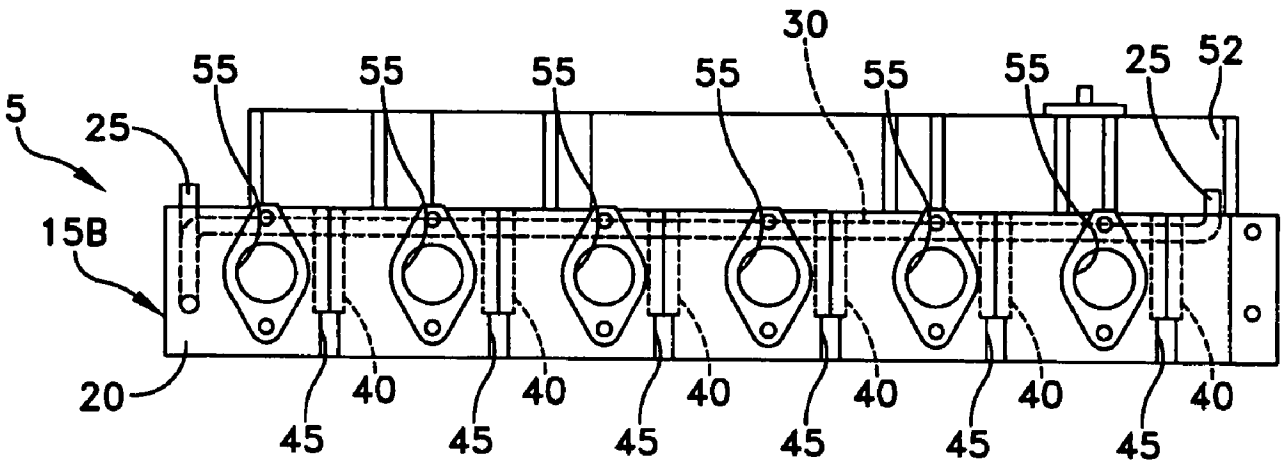
FIG. 2 illustrates an elevational view of the anti-explosion and anti-fire system shown in FIG. 1.

Referring to FIGS. 1 and 2, there is shown an anti-explosion and anti-fire system 5 for thermal regulation of high temperature surface portions 10 of a machine component 15 used in an underground mine.

In an embodiment, anti-explosion and anti-fire system 5 comprises an encapsulant material 20 disposed to cover high temperature surface portions 10 of machine component 15. Encapsulant material 20 prevents combustible material, such as gasses, coal dust, fuel, oils or other materials, in the underground mine from contacting high temperature surface portions 10 of machine component 15. Encapsulant material 20 transfers heat away from high temperature surface portions 10 of machine component 15.

Referring still to FIGS. 1 and 2, there is shown a heat transfer fluid conduit 25 in thermal connection with encapsulant material 20. Fluid conduit 25 is configured to receive at least a portion of the heat transferred away from high temperature surface portions 10 of machine component 15 by encapsulant material 20.

Looking again at FIGS. 1 and 2, a heat transfer fluid 30 is disposed within fluid conduit 25. Heat transfer fluid 30 transfers at least a portion of the heat received by fluid conduit 25 from encapsulant material 20 to another location away from high temperature surface portions 10 of machine component 15.

In an embodiment, machine component 15 of anti-explosion and anti-fire system 5 comprises a diesel engine 15A. A cylinder head 15B of diesel engine 15B comprises high temperature surface portions 10 of machine component 15.

Figure 3:
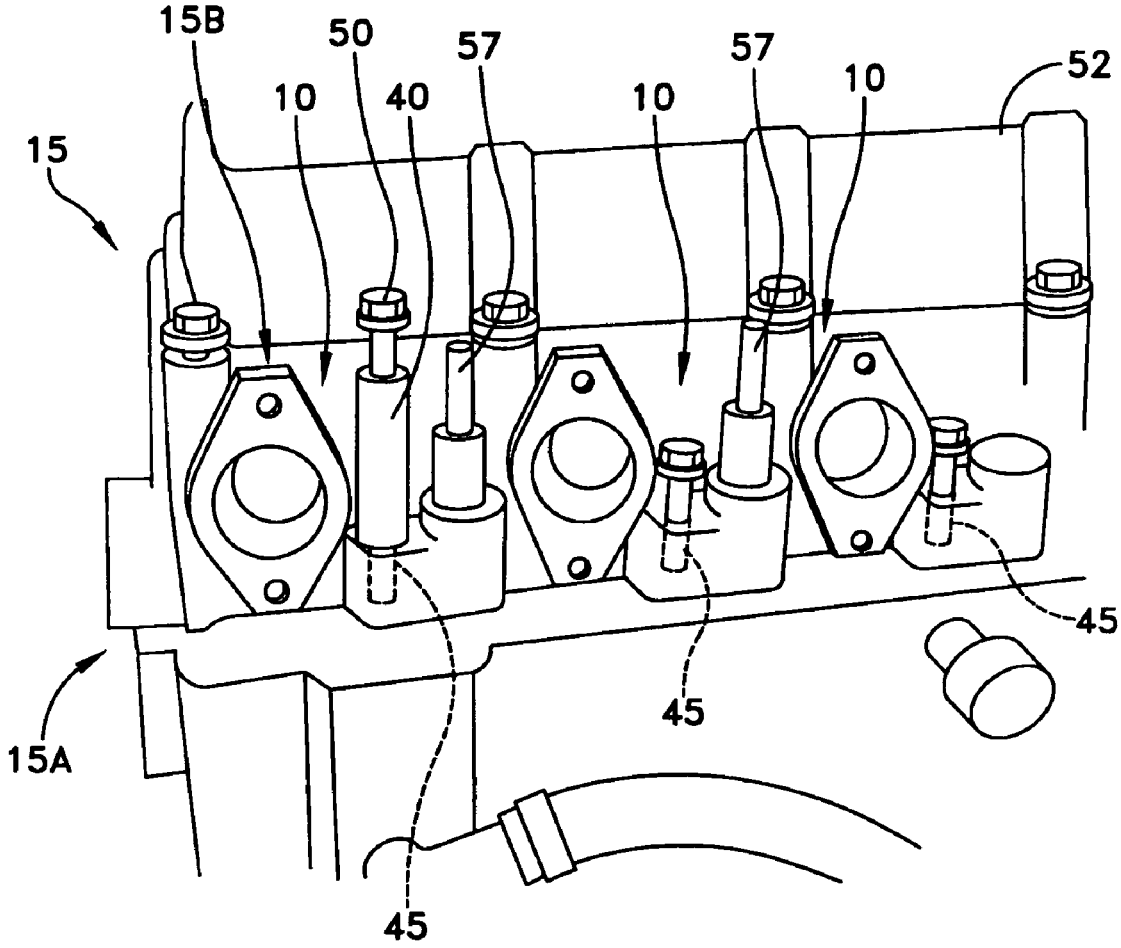
FIGS. 3–13 illustrate construction of the anti-explosion and anti-fire system shown in FIGS. 1 and 2.

In one embodiment, encapsulant material 20 is disposed on high temperature surface portions 10 of cylinder head 15B to permit selective detachment of cylinder head 15B from an engine block 35 (FIG. 3).

Spacers 40 are disposed through encapsulant material 20 and are positioned above screw passageways 45 in block 35. A set of screws 50 are selectively disposable through spacers 40. Spacers 40 and screws 50 permit selective detachment of cylinder head 15B from block 35. In an embodiment, valve cover 52 may be selectively removed from cylinder head 15B as encapsulant material 20 does not cover the bottom portion of valve cover 52.

Referring to FIG. 2, encapsulant material 20 is disposed on the cylinder head 15B to leave uncovered exhaust gas passageways 55.

Figure 14:
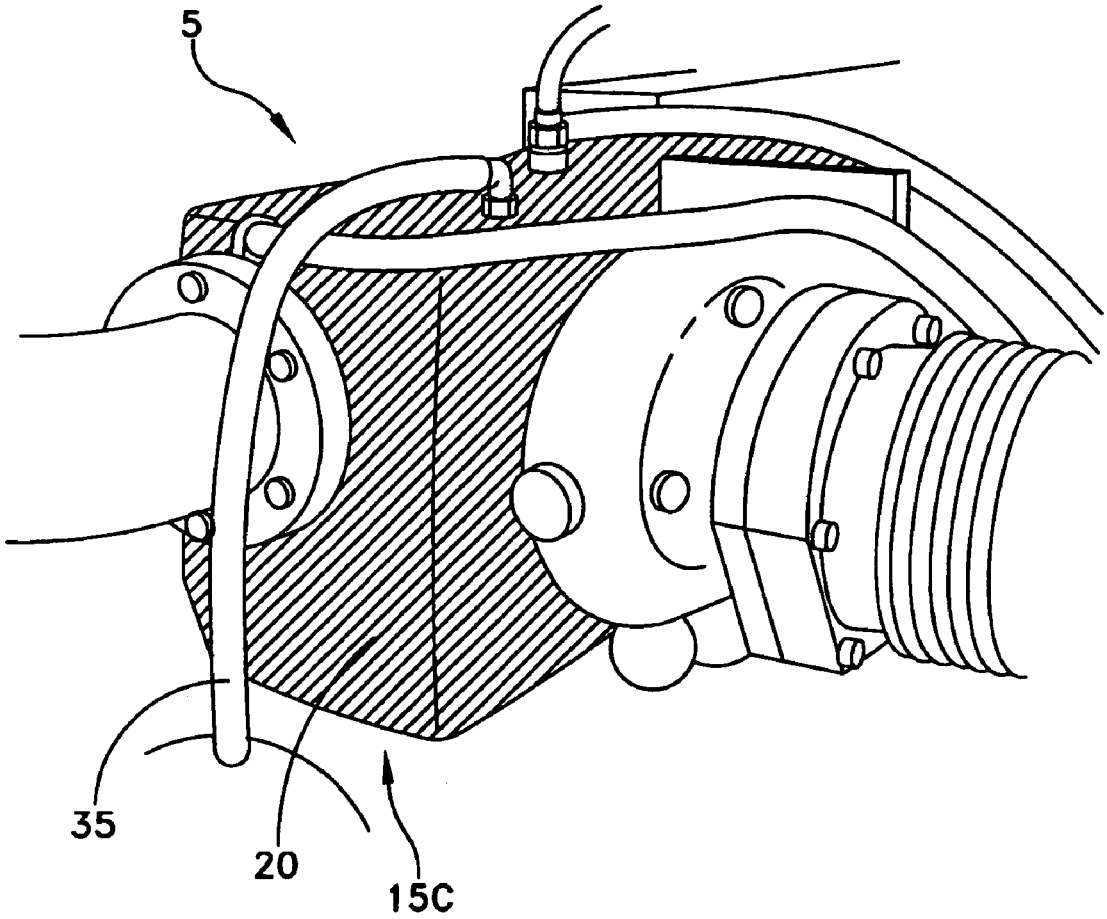
FIG. 14 illustrates another embodiment of an anti-explosion and anti-fire system having an encapsulant material disposed on high temperature surface portions of a turbo charger.

Referring to FIG. 14, and in an embodiment, there is provided an example of machine component 15 comprising a turbo charger 15C. Anti-explosion and anti-fire system 5 includes encapsulation material 20 conforming to turbo charger 15C. Fluid conduit 25 is disposed within encapsulation material 20 so as to efficiently transfer heat away from turbo charger 15C.

In an embodiment, encapsulant material 20 is applied as a conformal coating to a transmission, a braking unit, or another component requiring temperature control.

In one embodiment, encapsulant material 20 may include lead. In other embodiments, encapsulant material 20 may include one or more of zinc, tin, copper, silver, cast iron, and cast steel.

In one embodiment, fluid conduit 25 may include copper tubing. In other embodiments, fluid conduit 25 one or more of aluminum tubing, steel tubing, galvanized steel tubing, iron tubing, stainless steel tubing, and plastic tubing.

In one embodiment, heat transfer fluid 30 may include a solution of water and glycol. In other embodiments, heat transfer fluid 30 may include one or more of water, glycol, engine oil, transmission oil, and refrigerant gas.

In an embodiment, the dimensions of encapsulant material 20, the dimensions of fluid conduit 25 and the volume of heat transfer fluid 30 are selected to dissipate heat at the high temperature surface portions 10 of the machine component 15 from temperatures above a safety limit for fire and explosion in the underground mine so as to prevent combustible material, such as gasses, coal dust, fuel, oils or other materials, in the underground mine from contacting surface portions of the anti-explosion and anti-fire system 5 above the safety limit for fire and explosion.

Generally, the safety limit for fire and explosion in an underground mine is 302° Fahrenheit, as this is the ignition temperature of coal dust. For other materials, the safety limit for fire and explosion may be adjusted for the particular material. Methane has an ignition temperature of about 1000° Fahrenheit. However, this ignition temperature may be exceeded if coal dust or another combustible material ignites at a low temperature and subsequently rises.

In one embodiment, encapsulant material 20 surrounds fluid conduit 25. In an embodiment, encapsulant material 20 forms a tight seal with high temperature surface portions 10 of machine component 15.

In one embodiment, a threaded shank portion 57 is disposed into a threaded recess 59. Threaded shank portion 57 provides an anchor portion to attach encapsulant material 20 to cylinder head 15B. Threaded shank portion 57 may extend to a height equal to or less than the height of the encapsulant material 20, otherwise threaded shank portion 57 extends out of encapsulant material 20.

In an embodiment, a frame component 60 (FIGS. 6, 7 and 9–11) is provided in attachment to machine component 15. Frame component 60 retains encapsulant material 20. In one embodiment, at least a portion of frame component 60 is removed from machine component 15 after encapsulant material 20 covers high temperature surface portions 10. In one embodiment, at least a portion of frame component 60 is left in attachment to machine component 15 after encapsulant material 20 covers high temperature surface portions 10.

Figure 4:
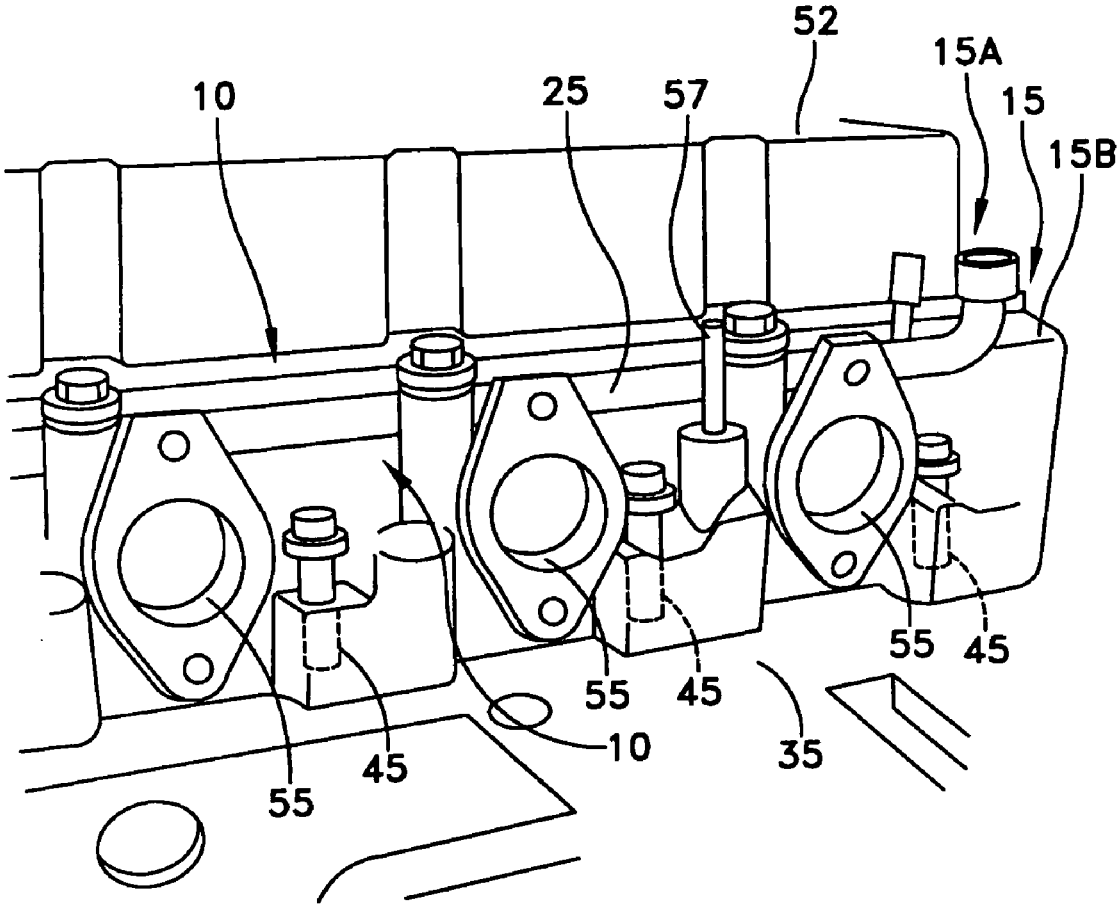
Figure 5:
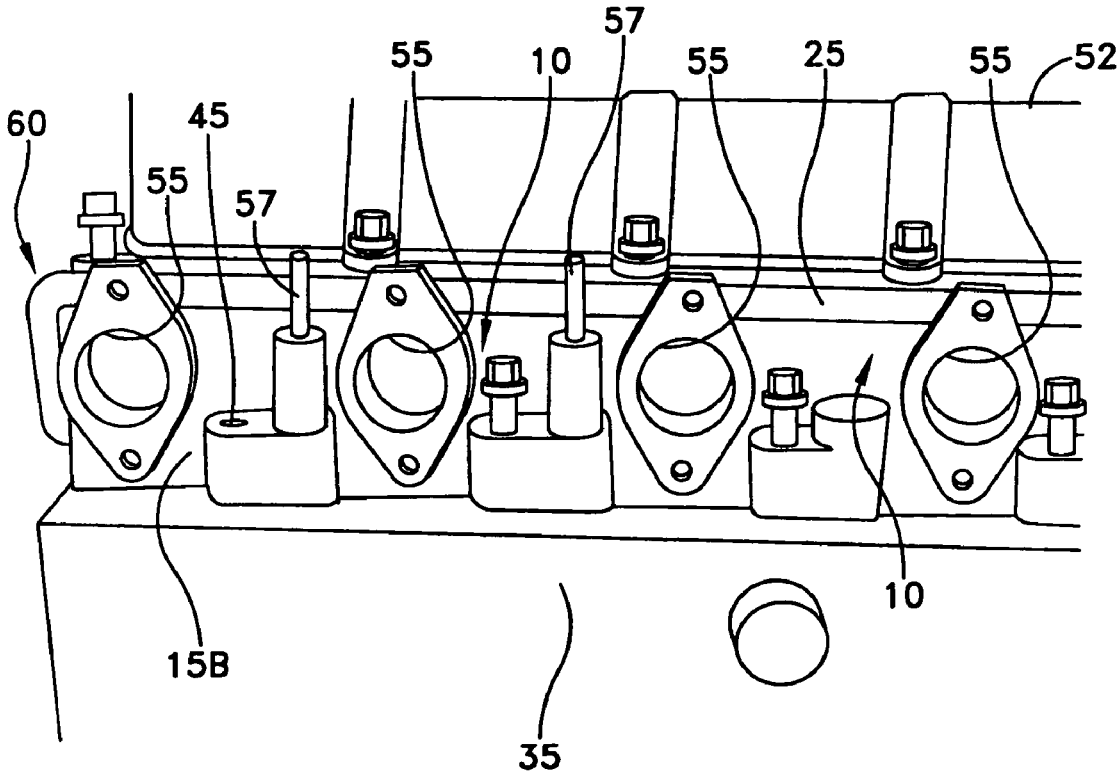
Figure 6:
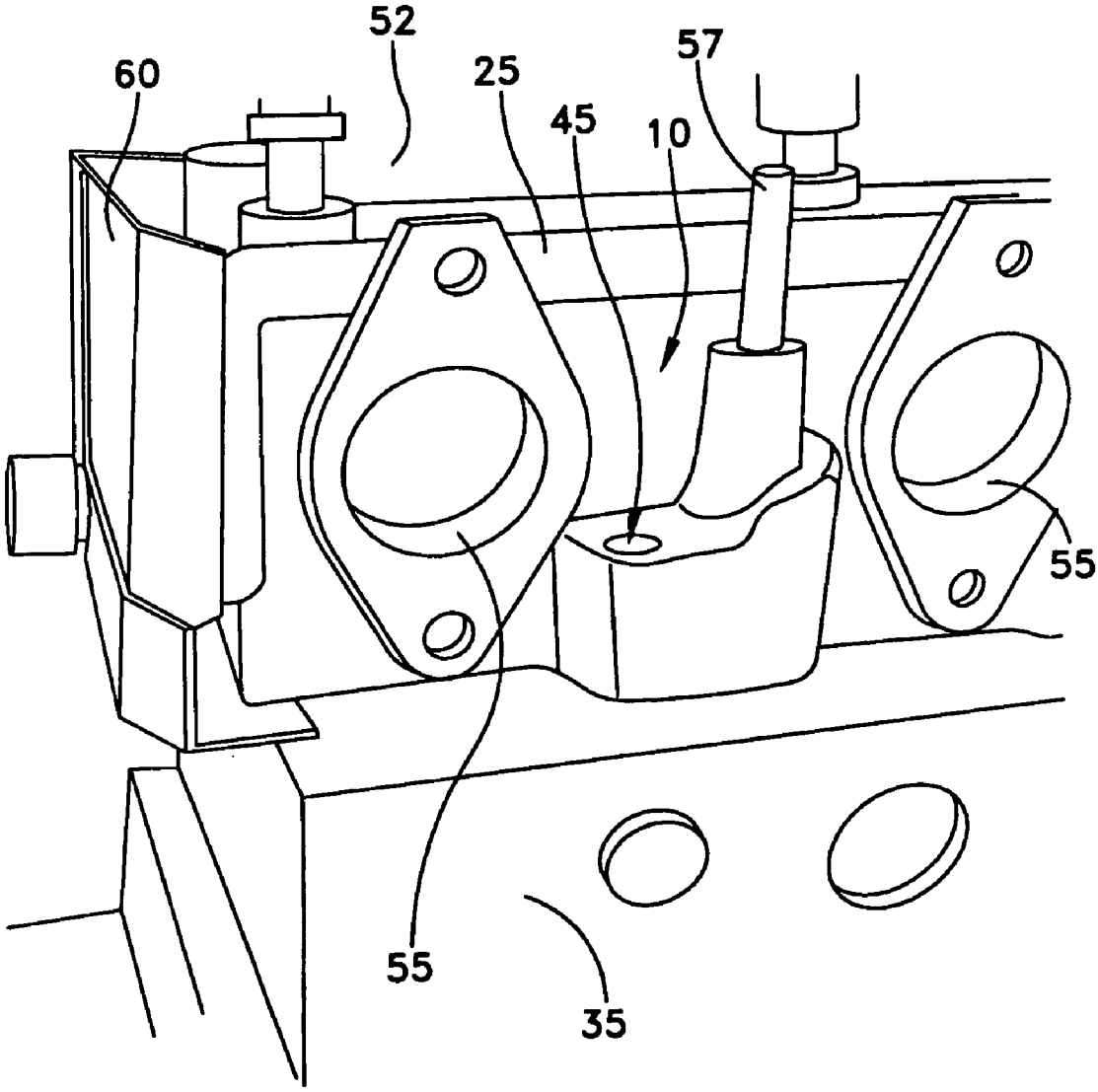

In an embodiment, there is provided a method for encapsulating high temperature surface portions 10 of cylinder head 15B of diesel engine 15A for regulation of temperature below a safety limit for fire and explosion in an underground mine. This generally comprises positioning a fluid conduit 25 adjacent the surface of cylinder head 15B. (See FIG. 4).

Next, this method generally comprises positioning encapsulant material 20 in thermal connection with the high temperature surface portions 10 of the cylinder head and fluid conduit 25. (See FIG. 11.) Encapsulant material 20 is positioned to cover high temperature surface portions 10 of cylinder head 15B so as to prevent combustible material, such as gasses, coal dust, fuel, oils or other materials in the underground mine from contacting high temperature surface portions 10 of the cylinder head above the safety limit for fire and explosion. Finally, this method generally comprises transferring heat from high temperature surface portions 10 of cylinder head 15B covered by encapsulant material 20 through heat transfer fluid 30 disposed within fluid conduit 25 to another location away from high temperature surface portions 10 of cylinder head 15B so as to prevent combustible material, such as gasses, coal dust, fuel, oils or materials, in the underground mine from contacting surface portions of the diesel engine at temperatures above the safety limit for fire and explosion. (See FIGS. 1 and 2).

Referring to FIGS. 3–13, there is shown various stages of the construction of an embodiment of system 5.

Looking at FIG. 3, and in an embodiment, a method for forming an encapsulating layer 20 comprises replacing relatively short screws attaching cylinder head 15B to block 35 with longer screws 50 together with spacers 40. Screws 50 and spacers 40 permit cylinder head 15B to be selectively removed from block 35 subsequent to placement of encapsulant material 20.

Referring to FIGS. 4–8, the method for forming encapsulating layer 20 comprises placing fluid conduit 25 adjacent to high temperature surface portions 10.

Figure 7:
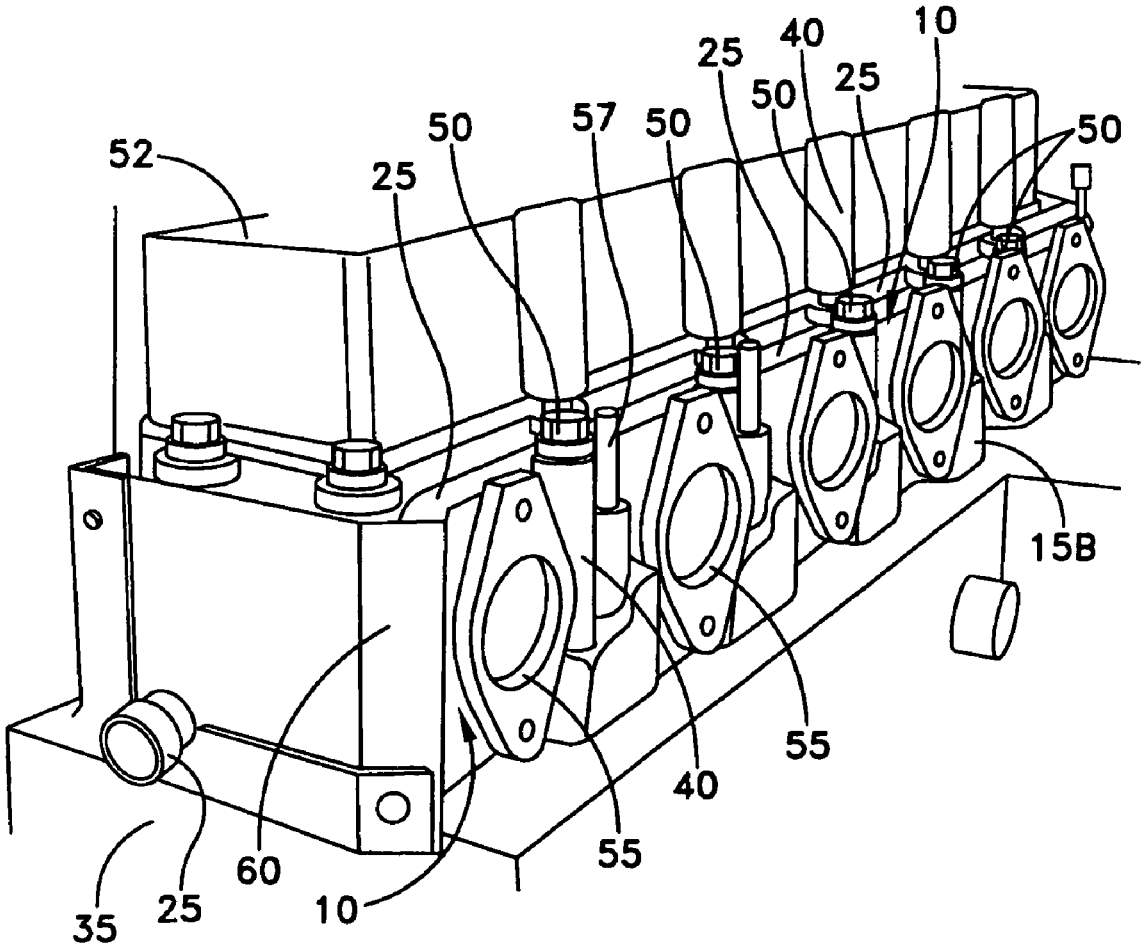
Figure 8:
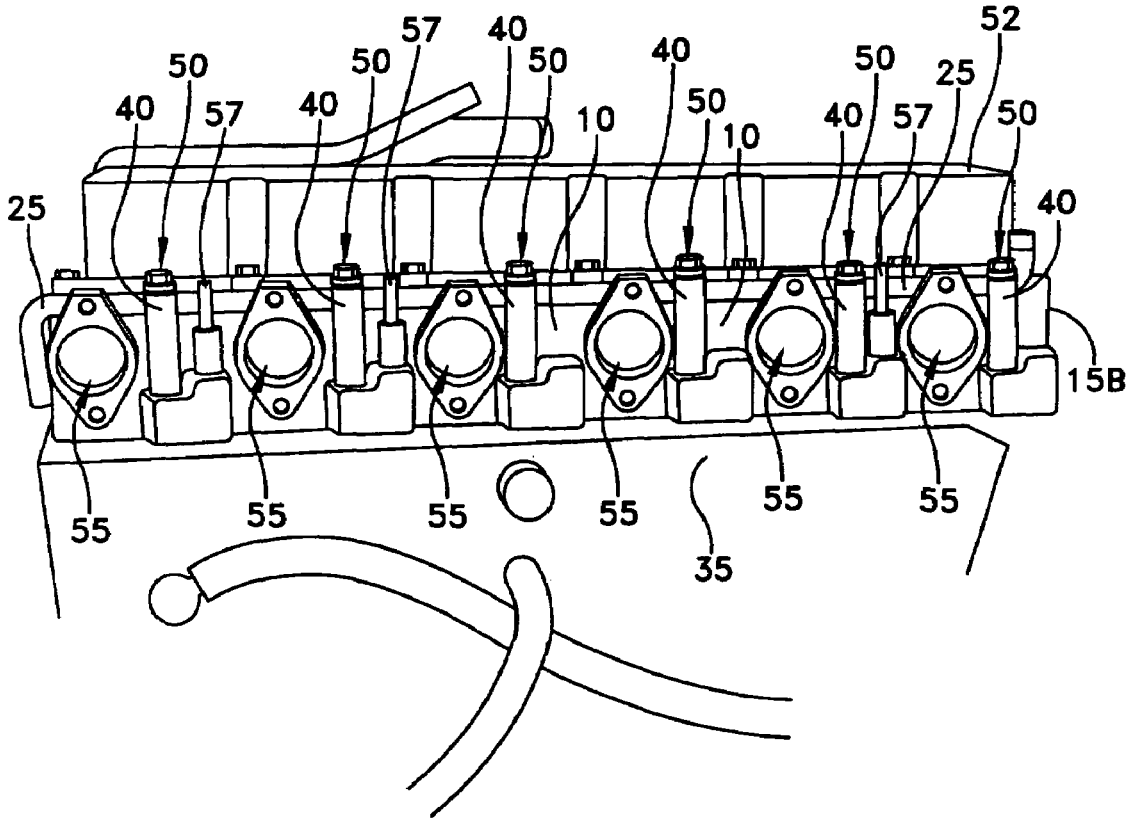
Figure 9:
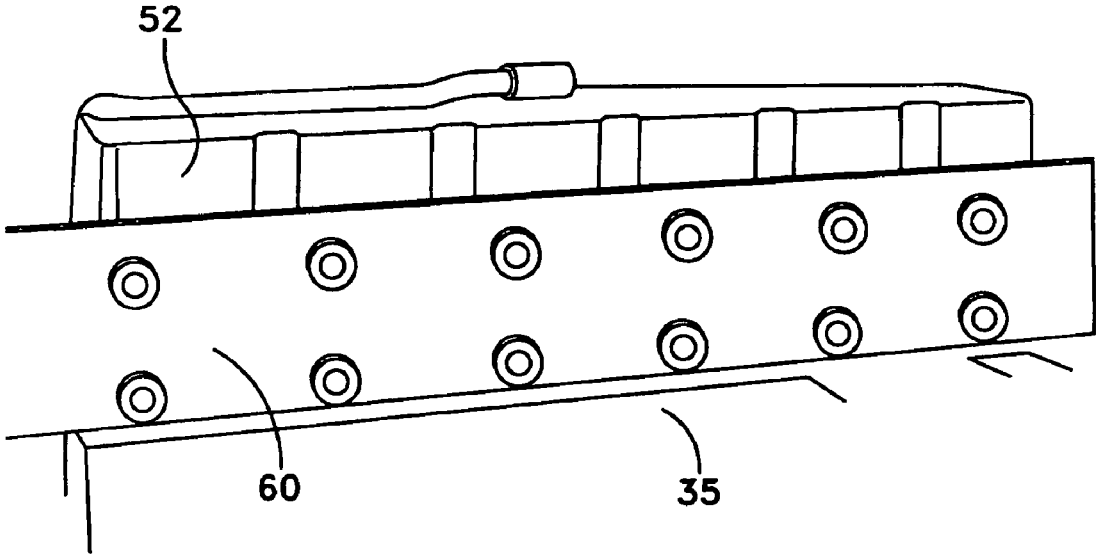
Figure 10:
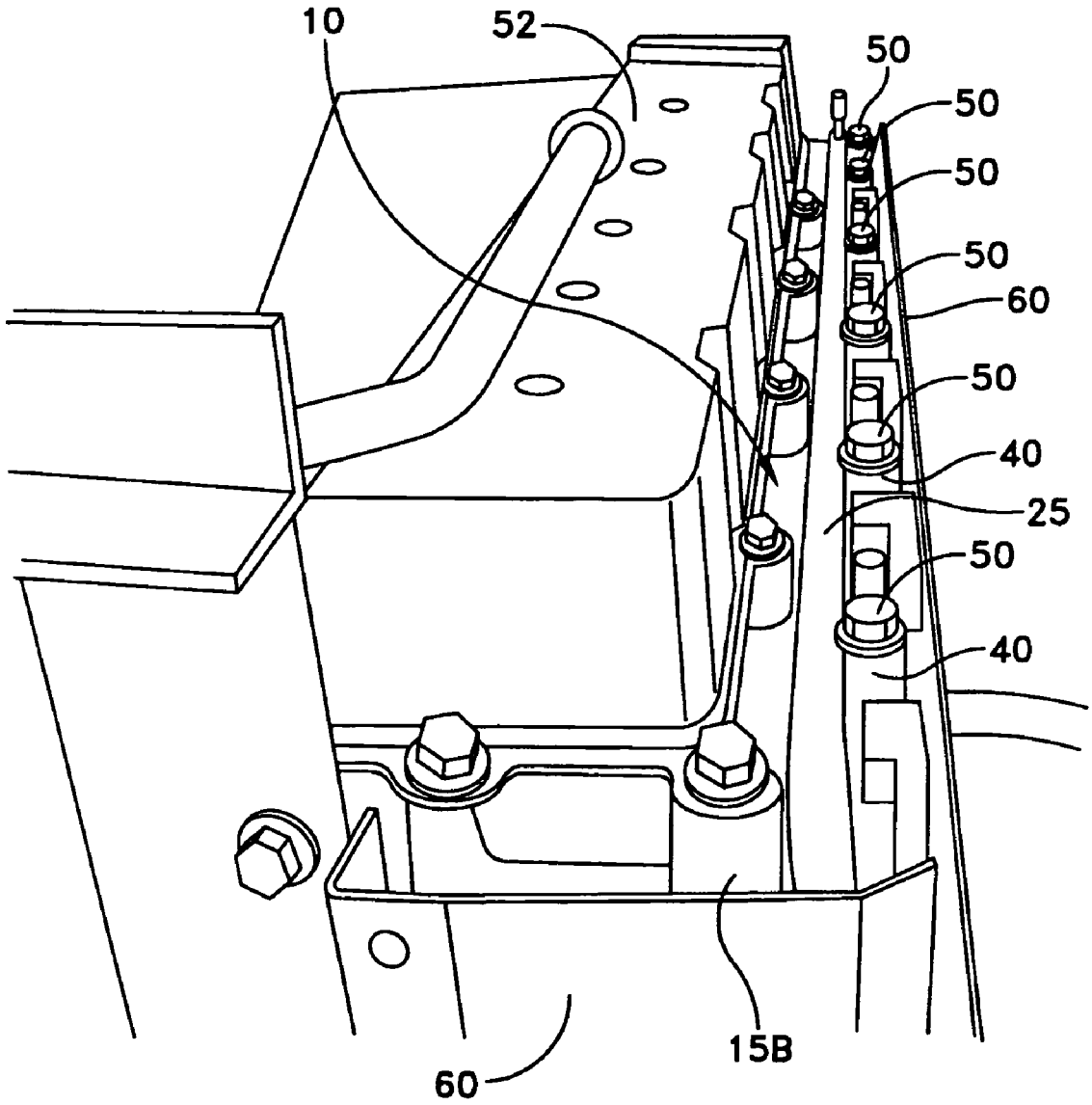

Looking at FIGS. 7, 9 and 10, the method for forming encapsulating layer 20 comprises placing frame component 60 adjacent to fluid conduit 25 so as to create a form for filling a bath of encapsulation material 20 in a fluid state.

Figure 11:
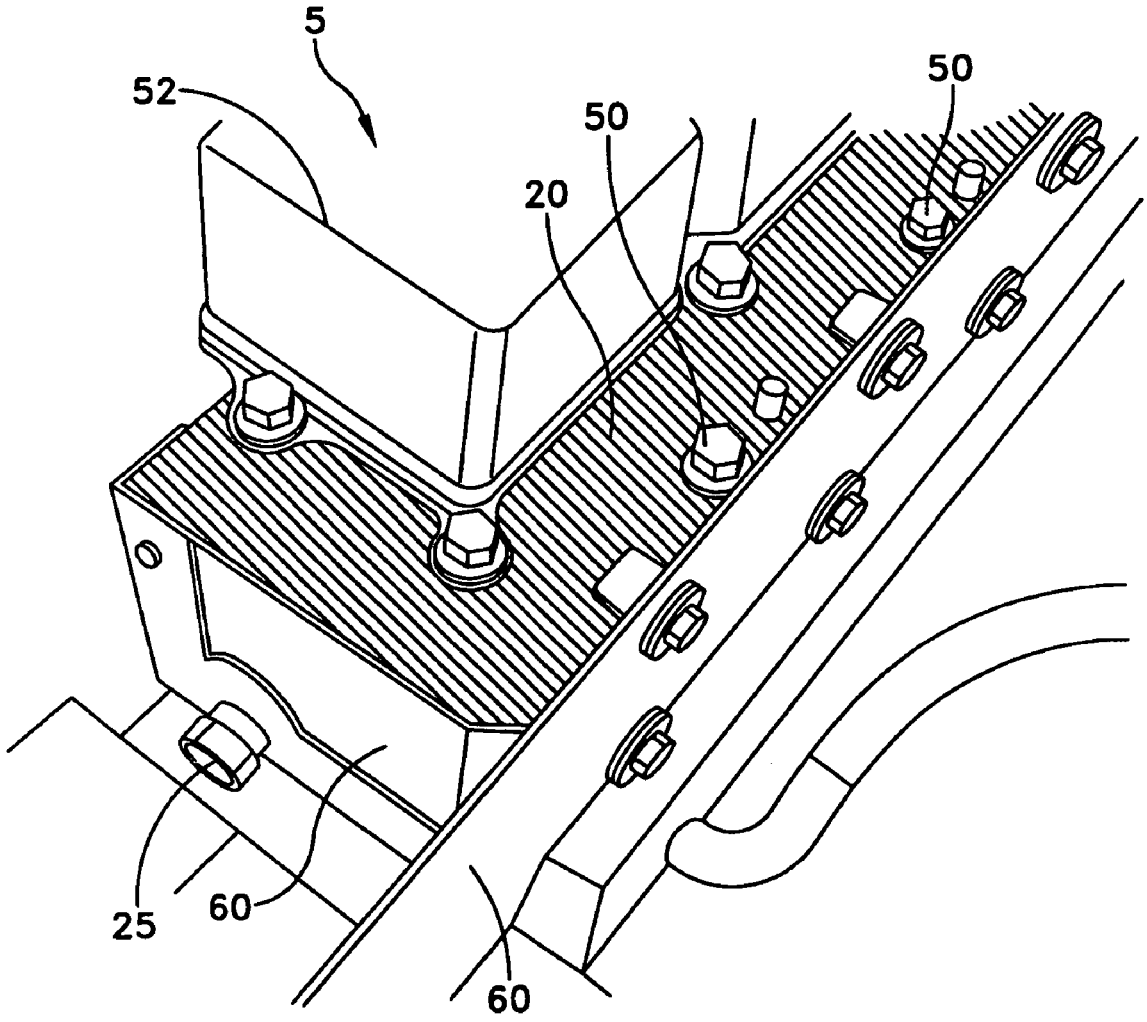

Referring to FIG. 11, and in an embodiment, the method for forming encapsulating layer 20 comprises adding the encapsulation material 20 in the fluid state up to a height equal to a top portion of the spacers 40.

Figure 12:
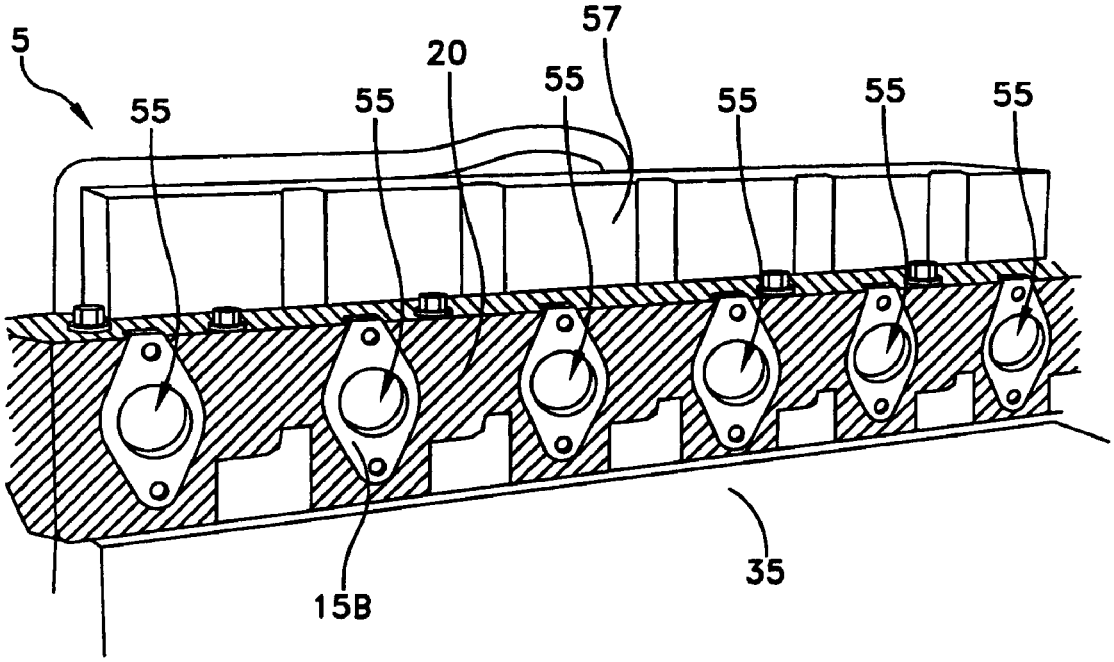

Looking now at FIG. 12, the method for forming encapsulating layer comprises removing at least a portion of frame component 60 after encapsulation material 20 has hardened.

Figure 13:
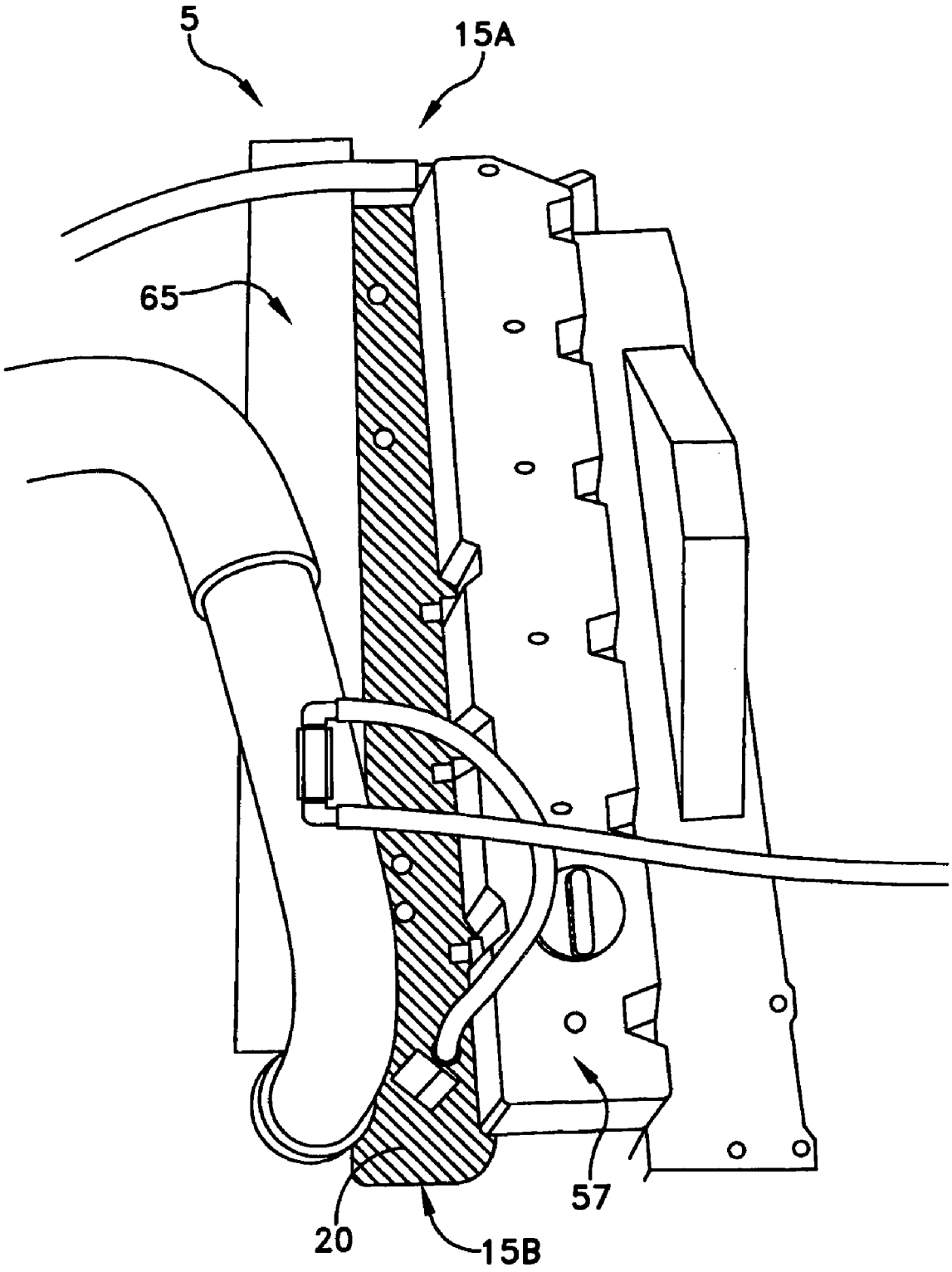

In FIG. 13, there is shown an embodiment of system 5 with an exhaust manifold 65 in connection with cylinder head 15B.

What is claimed is:

1. An anti-explosion and anti-fire system for thermal regulation of high temperature surface portions of a machine component used in an underground mine, the anti-explosion and anti-fire system comprising:

an encapsulant material disposed to cover the high temperature surface portions of the machine component, wherein the encapsulant material is disposed on the machine component to prevent combustible material in the underground mine from contacting the high temperature surface portions of the machine component, and wherein the encapsulant material transfers heat away from the high temperature surface portions of the machine component;

a fluid conduit in thermal connection with the encapsulant material, wherein the fluid conduit receives at least a portion of the heat transferred away from the high temperature surface portions of the machine component by the encapsulant material; and a heat transfer fluid disposed within the fluid conduit, wherein the heat transfer fluid transfers at least a portion of the heat received by the fluid conduit from the encapsulant to another location away from the high temperature surface portions of the machine component.

2. An anti-explosion and anti-fire system in accordance with claim 1, wherein a diesel engine comprises the machine component.

3. An anti-explosion and anti-fire system in accordance with claim 2, wherein a cylinder head of the diesel engine comprises the high temperature surface portions of machine component.

4. An anti-explosion and anti-fire system in accordance with claim 3, wherein the encapsulant material is disposed on high temperature surface portions of the cylinder head to permit selective detachment of the cylinder head from the engine block.

5. An anti-explosion and anti-fire system in accordance with claim 4, further comprising spacers are disposed through the encapsulant and positioned above screw passageways in the block, and a set of screws selectively disposable through the spacers, wherein the spacers and the screws permit selective detachment of the cylinder head from the block.

6. An anti-explosion and anti-fire system in accordance with claim 3, wherein the encapsulant material is disposed on the cylinder head to leave uncovered exhaust gas passageways.

7. An anti-explosion and anti-fire system in accordance with claim 1, wherein the machine component comprises a turbo charger.

8. An anti-explosion and anti-fire system in accordance with claim 1, wherein the encapsulant material comprises lead.

9. An anti-explosion and anti-fire system in accordance with claim 1, wherein the encapsulant material comprises at least one chosen from the group consisting of zinc, tin, copper, silver, cast iron, cast steel, brass, and bronze.

10. An anti-explosion and anti-fire system in accordance with claim 1, wherein the fluid conduit comprises copper tubing.

11. An anti-explosion and anti-fire system in accordance with claim 1, wherein the fluid conduit comprises at least one chosen from the group consisting of aluminum tubing, steel tubing, galvanized steel tubing, iron tubing, stainless steel tubing, and plastic tubing.

12. An anti-explosion and anti-fire system in accordance with claim 1, wherein the heat transfer fluid conduit comprises a solution of water and glycol.

13. An anti-explosion and anti-fire system in accordance with claim 1, wherein the heat transfer fluid conduit comprises at least one chosen from the group consisting of water, glycol, engine oil, transmission oil, and refrigerant gas.

14. An anti-explosion and anti-fire system in accordance with claim 1, wherein dimensions of the encapsulant material, dimensions of the fluid conduit and volume of the heat transfer fluid are selected to dissipate heat at the high temperature surface portions of the machine component from temperatures above a safety limit for fire and explosion in the underground mine so as to prevent combustible material in the underground mine from contacting surface portions of the anti-explosion and anti-fire system above the safety limit for fire and explosion.

15. An anti-explosion and anti-fire system in accordance with claim 1, wherein the encapsulant material surrounds the heat transfer fluid conduit.

16. An anti-explosion and anti-fire system in accordance with claim 1, wherein the encapsulant material forms a tight seal with the high temperature surface portions of the machine component.

17. An anti-explosion and anti-fire system in accordance with claim 1, wherein the encapsulant material is disposed on the machine component to prevent combustible material comprising at least one of a group comprising gasses, coal dust, fuel, and oils in the underground mine from contacting the high temperature surface portions of the machine component.

18. An anti-explosion and anti-fire system in accordance with claim 1, further comprising a frame component in attachment to the machine component, wherein the frame component retains the encapsulant material.

19. A diesel engine for use in an underground mine, the diesel engine comprising:

an encapsulant material disposed to cover high temperature surface portions of a cylinder head of the diesel engine, wherein the encapsulant material is disposed on the cylinder heat to prevent direct contact of combustible material in the underground mine with the high temperature surface portions of the cylinder head, and wherein the encapsulant material transfers heat away from the high temperature surface portions of the cylinder head;

a fluid conduit in thermal connection with the encapsulant material, wherein the fluid conduit receives at least a portion of the heat transferred by the encapsulant material away from the high temperature surface portions of the cylinder head; and a heat transfer fluid disposed within the fluid conduit, wherein the heat transfer fluid transfers at least a portion of the heat received by the fluid conduit from the encapsulant to another location away from the high temperature surface portions of the cylinder head; and wherein the encapsulant material and the cylinder head are attached together to permit selective removal of the cylinder head from the engine block; and wherein dimensions of the encapsulant material, dimensions of the fluid conduit and volume of the heat transfer fluid are selected to dissipate heat at the high temperature surface portions of the cylinder head from temperatures above a safety limit for fire and explosion in the underground mine so as to prevent combustible material in the underground mine from contacting surface portions of the diesel engine at temperatures above the safety limit for fire and explosion.

20. A method for encapsulating high temperature surface portions of a cylinder head of a diesel engine for regulation of temperature below a safety limit for fire and explosion in an underground mine, the method comprising:

positioning a fluid conduit adjacent the high temperature surface portions of the cylinder head; and positioning an encapsulant material in thermal connection with the high temperature surface portions of the cylinder head and the fluid conduit, wherein the encapsulant material is positioned to cover the surface of the cylinder head so as to prevent combustible material in the underground mine from contacting the high temperature surface portions of the cylinder head above the safety limit for fire and explosion;

whereby the encapsulant material and the fluid conduits are adapted to transfer heat from the high temperature surface portions of the cylinder head covered by the encapsulant material through a heat transfer fluid disposed within the fluid conduit to another location away from the high temperature surface portions of the cylinder head so as to prevent combustible material in the underground mine from contacting surface portions of the diesel engine at temperatures above the safety limit for fire and explosion.

21. A method in accordance with claim 20, wherein the encapsulant material is positioned to cover the surface of the cylinder head so as to prevent combustible material comprising at least one of a group comprising gasses, coal dust, fuel, and oils in the underground mine from contacting the high temperature surface portions of the cylinder head above the safety limit for fire and explosion.

22. A method for forming an encapsulating layer on a mechanical component for regulation of temperature, wherein the method comprises:

placing a fluid conduit adjacent to high temperature surface portions of the mechanical component;

placing a frame component adjacent to the fluid conduit so as to create a form for filling a bath of encapsulation material in a fluid state;

adding encapsulation material adjacent to high temperature surface portions of the mechanical component, and removing at least a portion of the frame component after encapsulation material has hardened.

23. A method for forming an encapsulating layer in accordance with claim 22, wherein the mechanical component is a cylinder head, and further comprising replacing relatively short screws attaching the cylinder head to an engine block with longer screws and spacers so as to permit selective removal of the cylinder head from block 35 subsequent to placement of the encapsulant material.

24. A method for forming an encapsulating layer in accordance with claim 23, further comprising adding the encapsulation material in the fluid state up to a height equal to a top portion of the spacers.

25. A method for forming an encapsulating layer in accordance with claim 22, wherein the encapsulant material is added to cover the surface of the mechanical component so as to prevent combustible material comprising at least one of a group comprising gasses, coal dust, fuel, and oils in the underground mine from contacting the high temperature surface portions of the mechanical component above the safety limit for fire and explosion.

* * * * *